US006776297B2

(12) United States Patent
Eustace

(10) Patent No.: US 6,776,297 B2
(45) Date of Patent: Aug. 17, 2004

(54) MOBILE SHELVING SYSTEM AND METHOD OF ASSEMBLY

(75) Inventor: Brian Eustace, Sierra Madre, CA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/225,980

(22) Filed: Aug. 22, 2002

(65) Prior Publication Data

US 2004/0035810 A1 Feb. 26, 2004

(51) Int. Cl.[7] ..... A47F 5/00

(52) U.S. Cl. ..... 211/162; 211/187; 211/189

(58) Field of Search ..... 211/162, 151, 211/103, 186, 187, 189; 312/131, 132, 198–201, 349, 350, 265.1–265.6; 248/235, 241, 243, 250

(56) References Cited

U.S. PATENT DOCUMENTS

| | | | | | |
|---|---|---|---|---|---|
| 1,504,522 | A | | 8/1924 | Sherer | |
| 1,880,179 | A | | 9/1932 | Onions | |
| 1,952,111 | A | | 3/1934 | Bales | |
| 2,915,195 | A | | 12/1959 | Crosby | |
| 3,152,698 | A | * | 10/1964 | Maddox | 211/126.15 |
| 3,169,810 | A | | 2/1965 | Levy et al. | |
| 3,221,894 | A | * | 12/1965 | Knuth | 211/134 |
| 3,399,784 | A | * | 9/1968 | Buchbinder et al. | 211/151 |
| 3,865,446 | A | | 2/1975 | Mastronardi | |
| 3,923,354 | A | | 12/1975 | Young | |
| 3,967,868 | A | | 7/1976 | Baker, Jr. | |
| 4,017,131 | A | | 4/1977 | Camenisch | |
| 4,153,312 | A | * | 5/1979 | Taniwaki | 312/198 |
| 4,173,934 | A | | 11/1979 | Searby | |
| 4,307,922 | A | * | 12/1981 | Rhodes, Jr. | 312/198 |
| 4,317,523 | A | | 3/1982 | Konstant et al. | |
| 4,371,221 | A | * | 2/1983 | Citterio | 312/199 |
| 4,711,183 | A | | 12/1987 | Handler et al. | |
| 5,007,351 | A | | 4/1991 | Muth | |
| 5,160,198 | A | * | 11/1992 | Fillon | 366/198 |
| 5,199,585 | A | | 4/1993 | Schafer | |
| 5,265,740 | A | * | 11/1993 | Hodsden et al. | 211/187 |
| 5,295,591 | A | | 3/1994 | Slater | |
| 5,349,909 | A | * | 9/1994 | Smit et al. | 108/107 |
| 5,452,812 | A | * | 9/1995 | Niequist et al. | 211/187 |
| 5,597,217 | A | * | 1/1997 | Hoska et al. | 312/201 |
| 5,611,442 | A | * | 3/1997 | Howard | 211/187 |
| 5,632,389 | A | | 5/1997 | Rosenband | |
| 5,718,441 | A | * | 2/1998 | Kern et al. | 280/79.3 |
| 5,797,503 | A | * | 8/1998 | Stevens et al. | 211/187 |
| 6,112,917 | A | * | 9/2000 | Baker et al. | 211/162 |

* cited by examiner

*Primary Examiner*—Jennifer E. Novosad
(74) *Attorney, Agent, or Firm*—Ronald A. Sandler; Jones Day

(57) ABSTRACT

A mobile shelving system having tracks and multiple shelf units for moving along the tracks. A shelf unit includes vertical posts that are attached to a carriage using fasteners that are part of the carriage. U-shaped clips connect to the posts and have slots that also accommodate flanges of shelves so that mounting shelves is facilitated. The shelves include a series of slits for receiving tabs that are part of barrier elements. The barrier elements act to limit movement of file folders stored on the shelves.

20 Claims, 11 Drawing Sheets

117
114
30
120
122
118
116

124
128
30
102
96
116
120
106
118
122
108
117
110
112

66
236
234
227
228
232
14-14
230

230

232
240

MOBILE SHELVING SYSTEM AND METHOD OF ASSEMBLY

BACKGROUND OF THE INVENTION

1. Field of the Invention

The present invention relates to a mobile shelving system and more particularly to a simplified mobile shelving system to make assembly easier, faster and less expensive.

2. Description of the Related Art

Mobile shelving systems are generally defined as storage systems having movable shelf units so that only one access aisle is available and required. With such a system, the shelf units are stored abutting or closely adjacent each other. This arrangement saves considerable space when compared to stationary shelf units having access aisles for each unit. Mobile shelving systems include a track and carriages for rolling on the track. The system also includes a drive mechanism which may be manual or motor driven to cause the shelf units to move along the track. Examples of mobile shelving systems are described in U.S. Pat. Nos. 3,923,354; 3,967,868; 4,017,131 and 5,007,351.

Shelf units usually include vertical standards, uprights or posts, as well as shelves and devices to mount the shelves to the posts, known as brackets, keys or clips. Various examples of such shelf units are shown in U.S. Pat. Nos. 1,880,179; 1,952,111; 3,169,810; 3,306,466; 4,173,934; 4,317,523; 4,711,183; 5,199,585; and 5,295,591.

BRIEF SUMMARY OF THE INVENTION

What is described here is a mobile shelving system including a carriage having fasteners for attaching members of the carriage together, vertically disposed corner frame members connected to the carriage, frame posts also vertically disposed located intermediate the corner frame members and being connected to the carriage using carriage fasteners, a plurality of clips for connecting shelves to the corner frame members and to the frame posts, a plurality of shelves connected to the corner frame members and the posts, and a plurality of barrier elements connected to selected ones of the plurality of shelves for limiting the depth of storage insertion. The method of assembly is also described.

An advantage achieved with the present invention, which is believed not to be available in earlier related devices, is that the mobile shelving system disclosed here is simplified to make assembly easier, faster and less expensive.

A more complete understanding of the present invention and other objects, advantages and features thereof will be gained from a consideration of the following description of a preferred embodiment read in conjunction with the accompanying drawing provided herein. The preferred embodiment represents an example of the invention which is described here in compliance with Title 35 U.S.C. section 112 (first paragraph), but the invention itself is defined by the attached claims.

DETAILED DESCRIPTION OF A PREFERRED EMBODIMENT OF THE INVENTION

Figure 1:
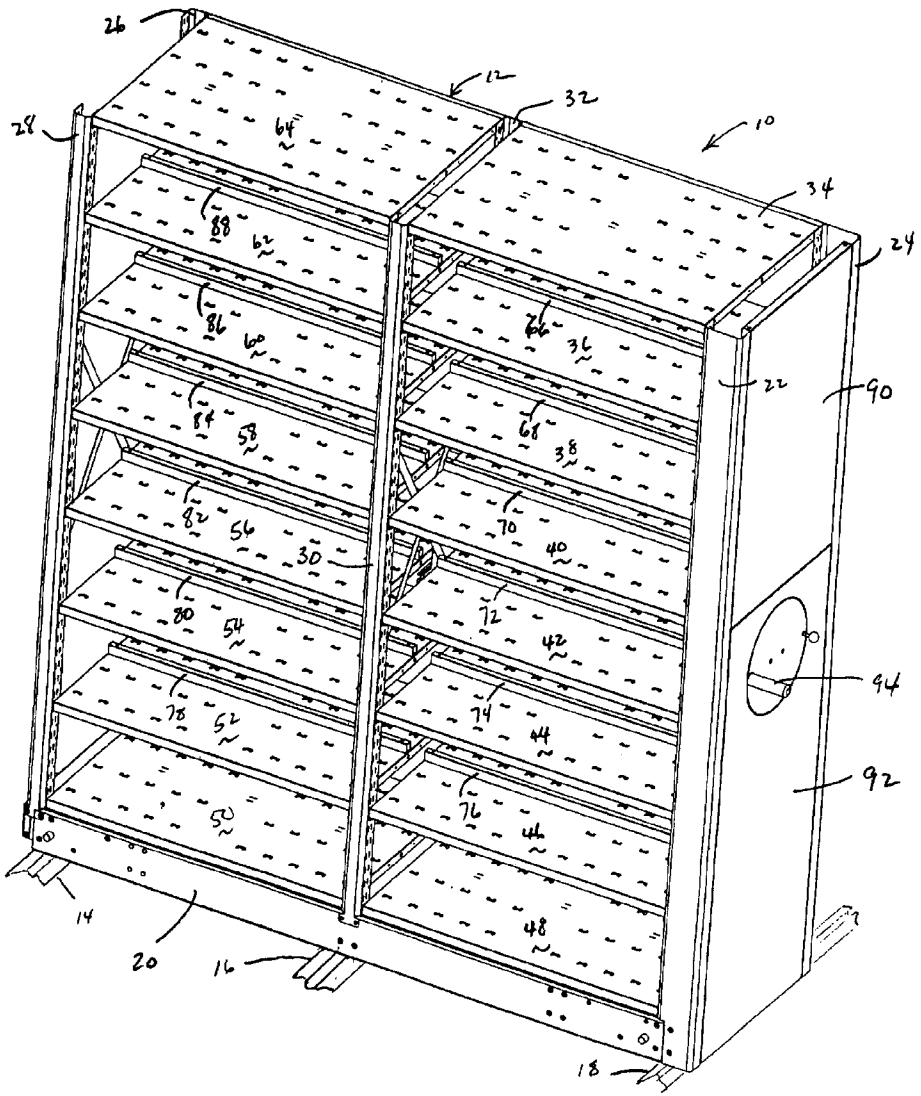
FIG. 1 is an isometric view of a portion of a mobile shelving system.

While the present invention is open to various modifications and alternative constructions, the preferred embodiment shown in the various figures of the drawing will be described herein in detail. It is understood, however, that there is no intention to limit the invention to the particular embodiment, form or example disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Figure 2:
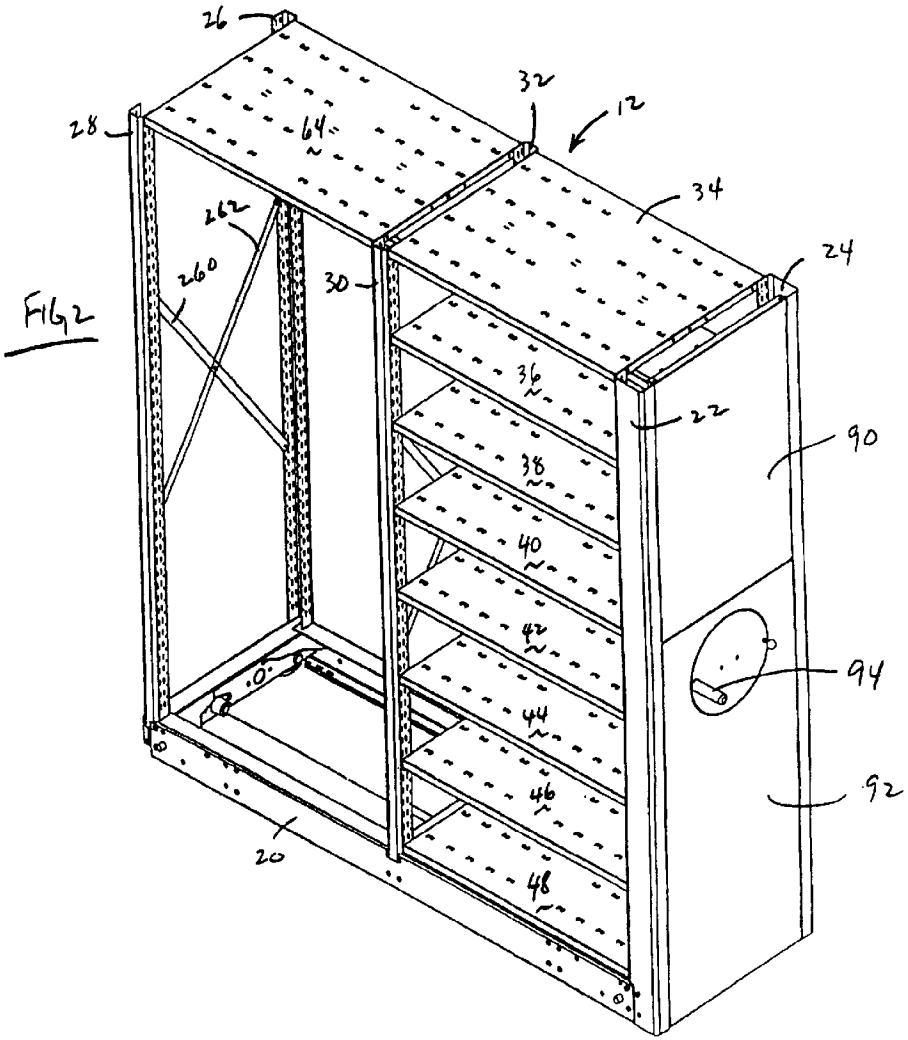
FIG. 2 is an isometric view of a partially assembled shelf unit.

A portion of a mobile shelving system 10 is shown in FIGS. 1 and 2. The system includes a shelf unit 12 and three tracks 14, 16 and 18. In a full system a plurality of shelf units will move along the tracks. The number of shelf units and their size is a function of storage requirements and does not impact the disclosure here. The shelf unit 12 includes a carriage 20 to which is mounted a set of wheels (not shown), four corner frame members or posts 22, 24, 26, 28 and two intermediate frame posts 30, 32. Mounted to the corner posts and intermediate posts are a plurality of shelves 34, 36, 38, 40, 42, 44, 46, 48, 50, 52, 54, 56, 58, 60, 62, 64. Mounted to most of the shelves are barrier elements 66, 68, 70, 72, 74, 76, 78, 80, 82, 84, 86, 88. Of course, more posts and shelves may be mounted to the carriage if desired.

Mounted to the two right corner members 22, 24 is an upper end panel 90 and a lower end panel 92. A crank handle 94 is attached to a transmission system (not shown) for providing the transfer of motive force from the crank to the wheels to move the shelf unit along the tracks. Instead of the crank and transmission, a motor and drive system may be used so that only a small switch is mounted to the lower panel.

Figure 3:
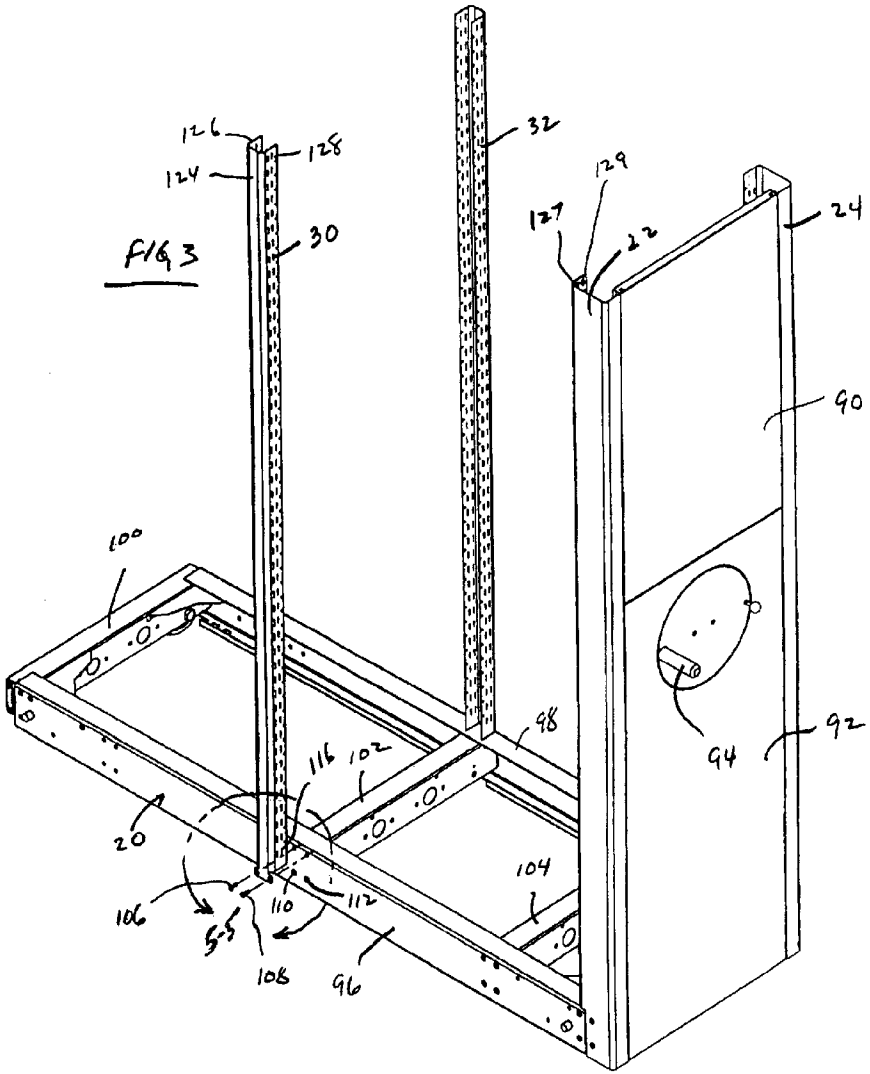
FIG. 3 is a partially exploded isometric view of a shelf unit illustrating assembly of a frame post to a carriage.
Figure 4:
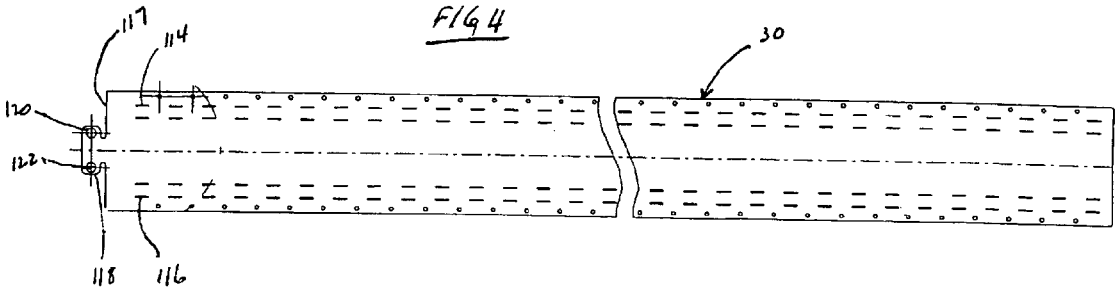
FIG. 4 is a plan view of a frame post before being fully formed.
Figure 5:
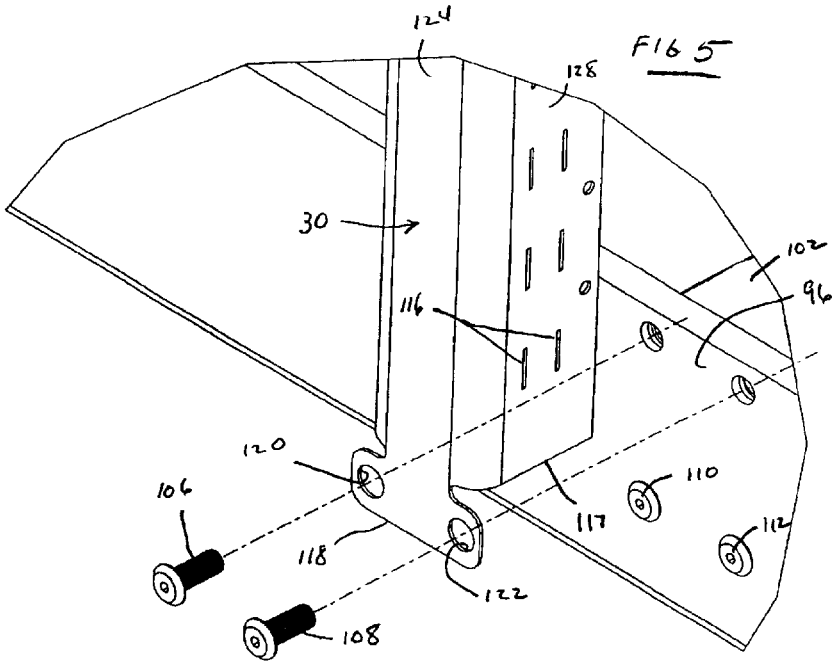
FIG. 5 is an exploded isometric view of the frame post viewed within the circle 5—5 of FIG. 3.

Focusing on the frame posts, FIGS. 3, 4 and 5, the carriage 20 includes two longitudinal frame members 96, 98 and four cross members 100, 102, 104 (of which only three cross members are shown). The cross members are attached to the longitudinal frame members by screw fasteners, such as the screws 106, 108, 110, 112 for the cross member 102. A feature of the mobile shelving system disclosed here is that the same screw fasteners used to connect the carnage members (the longitudinal frame members and the cross members) are also used to attach the intermediate posts 30, 32 and the corner posts 22, 24, 26, 28 to the carriage.

Each intermediate post, for example, is initially formed in a generally rectangular shape (see FIG. 4) with two rows of aligned slits, such as the slit pairs 114 and 116, extending in a longitudinal direction. At what becomes the lower end 117 of the vertically disposed frame post 30 is an upside down T-shaped tab 118 having two fastener receiving openings 120, 122 in the head of the T, spaced from one another in a lateral direction.

When the frame post is fully formed (see FIGS. 3 and 5), the flat, rectangular shape is changed to a generally U-shape configuration having a base portion 124 and two arm portions 126, 128 where the arm portions extend in planes parallel to the direction of movement of the shelf unit on the tracks. In this maimer the slit pairs are aligned parallel to slit pairs 127, 129 in the corner posts 22 and are provided to facilitate the horizontal mounting of the shelves.

As shown in FIGS. 3 and 5, there are already four screw fasteners 106, 108, 110, 112 in the longitudinal carriage member 96 for attaching the cross member 102. Two of the screw fasteners 106, 108 not only attach the carriage cross member to the carriage longitudinal member but also attach the frame post 30 to the carriage 20. Thus, the two screw fasteners pass through the openings 120, 122 in the T-shaped tab 118 before entering the longitudinal member 96 and the cross member 102.

Figure 6:
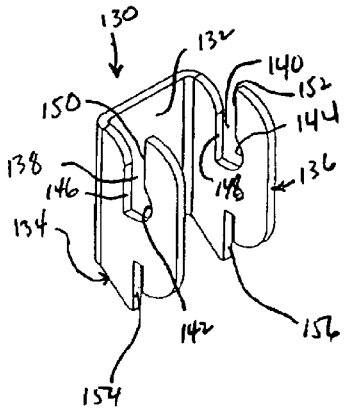
FIG. 6 is an isometric view of a clip used in the mobile shelving system.
Figure 7:
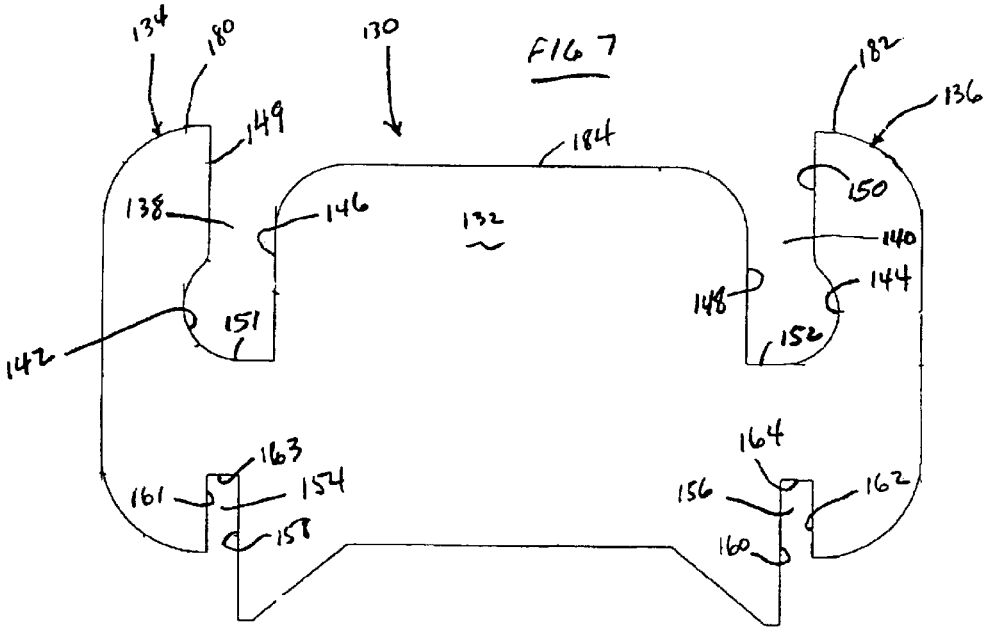
FIG. 7 is a plan view of the clip before final forming.

Referring now to FIGS. 6 and 7, a clip 130 used to connect a shelf to the corner and intermediate posts is illustrated. The clip has a generally C-shaped configuration as shown in FIG. 6, including a base portion 132 and two arm portions 134, 136. Each of the arms includes an upper, wide slot 138, 140 having generally parallel edges with bulbous portions 142, 144. Each wide slot includes an outer edge 146, 148, an inner edge 149, 150 and a bottom edge 151, 152. The inner edges 149, 150 of the wide slots extend to a higher elevation than the outer edges 146, 148 when the clip is operatively disposed. Each of the arm portions also includes a lower, narrow slot 154, 156 which has an outer edge 158, 160, an inner edge 161, 162, and a bridge edge 163, 164 where the outer edge is approximately twice the length of the inner edge. The inner edges 149, 150 of the upper slots and the inner edges 161, 162 of the lower slots are aligned with one another and will bear against an inner wall 166, FIG. 8, of a post when in use.

The wide slots 138, 140 are approximately twice the width of the narrow slots 154, 156. In use, the arm portions 134, 136 are received by slits in the corner and intermediate posts to allow the clip 130 to be operatively connected. The added width of the upper slots allows a flange from a shelf to be received and thereby allows the mounting of a shelf to four aligned, but spaced apart clips.

Figure 8:
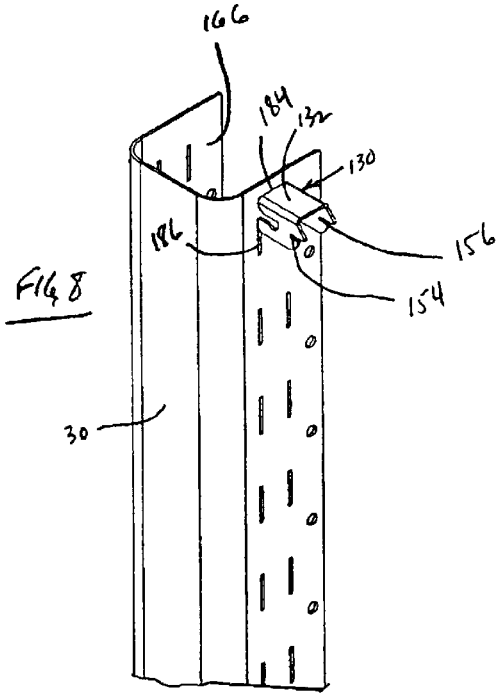
FIG. 8 is an isometric view of the clip at the beginning of insertion into slits on the frame post.
Figure 9:
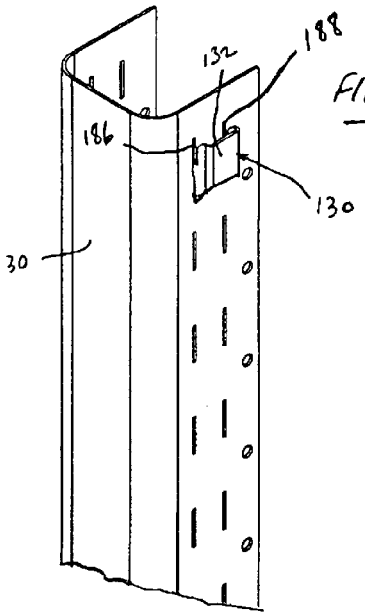
FIG. 9 is an isometric view of the clip inserted into the frame post.

FIGS. 8 and 9 illustrate the process of installing the clip 130 to the post 30. The clip is disposed so that the base portion 132 is at approximately ninety degrees to the post. Because end portions 180, 182, FIG. 7, of the arms 134, 136 extend beyond an upper edge 184 of the base portion 132, the upper portions of the arms will be received by a pair of slits 186, 188 when the upper edge 184 contacts the post. The next step is to rotate the clip approximately ninety degrees counterclockwise in the FIGS. 8 and 9 orientation to align the base portion 132 parallel to the post. Thereafter, the clip is pushed downwardly until the bridge edges 163, 164 of the narrow slots 154, 156 engage the post as shown in FIG. 9. As mentioned earlier, the wide slots 138, 140 not only help secure the clip to the post but provide sufficient space to mount a shelf.

Figure 10:
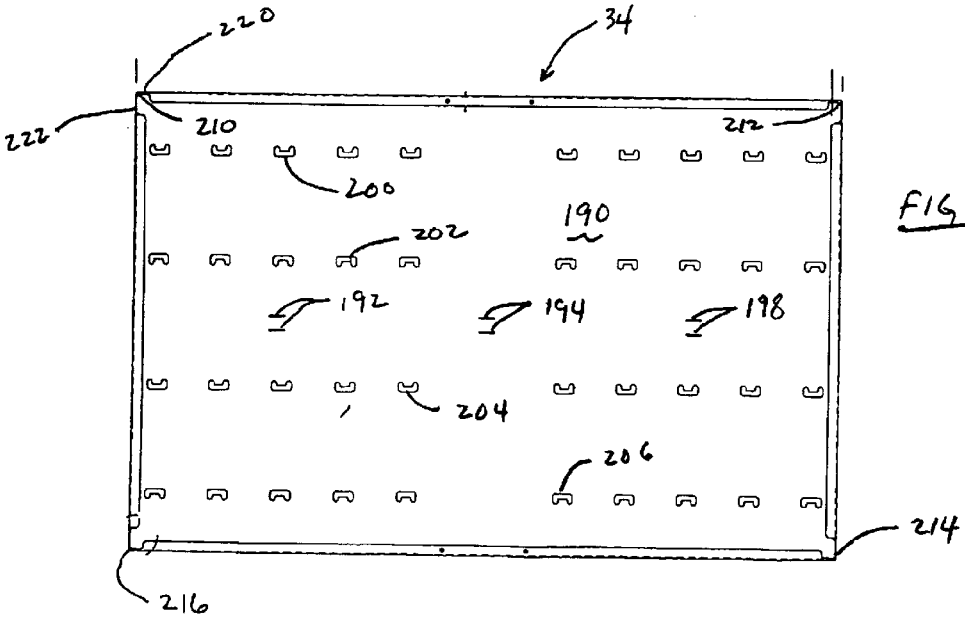
FIG. 10 is a bottom plan view of a shelf of the mobile shelving system.
Figure 11:
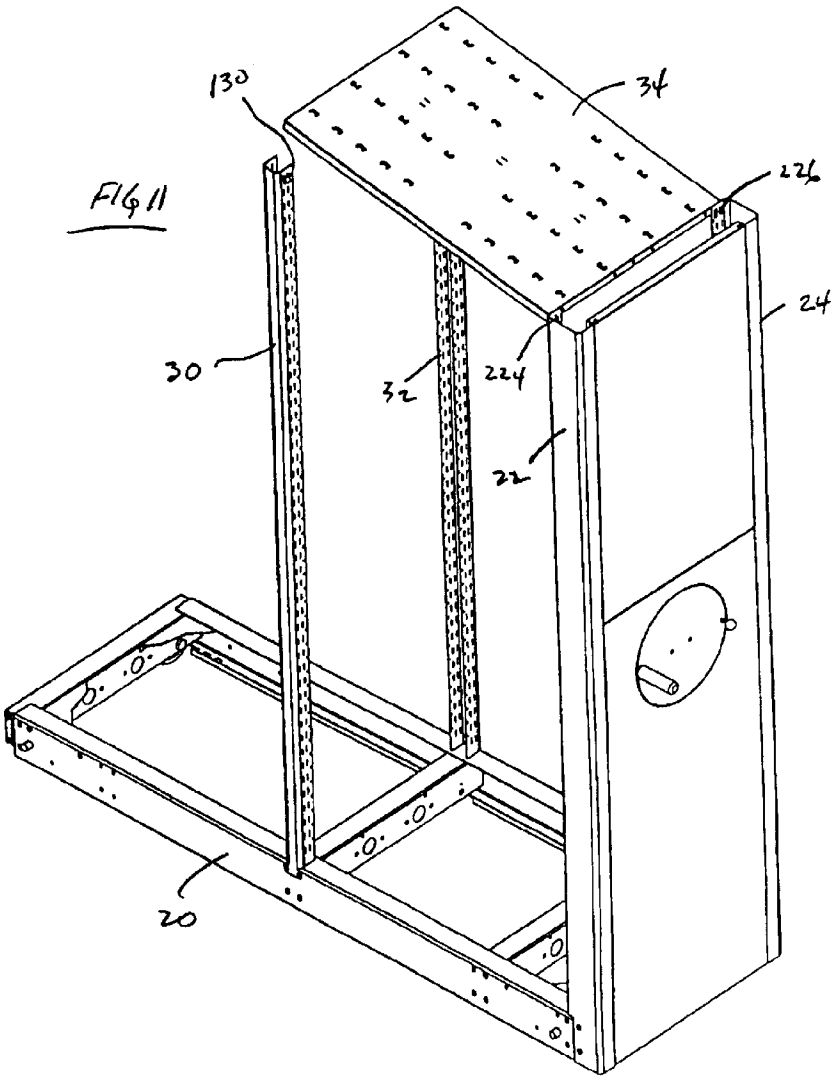
FIG. 11 is an isometric view of a partially assembled shelf unit showing the partial installation of the top shelf.
Figure 12:
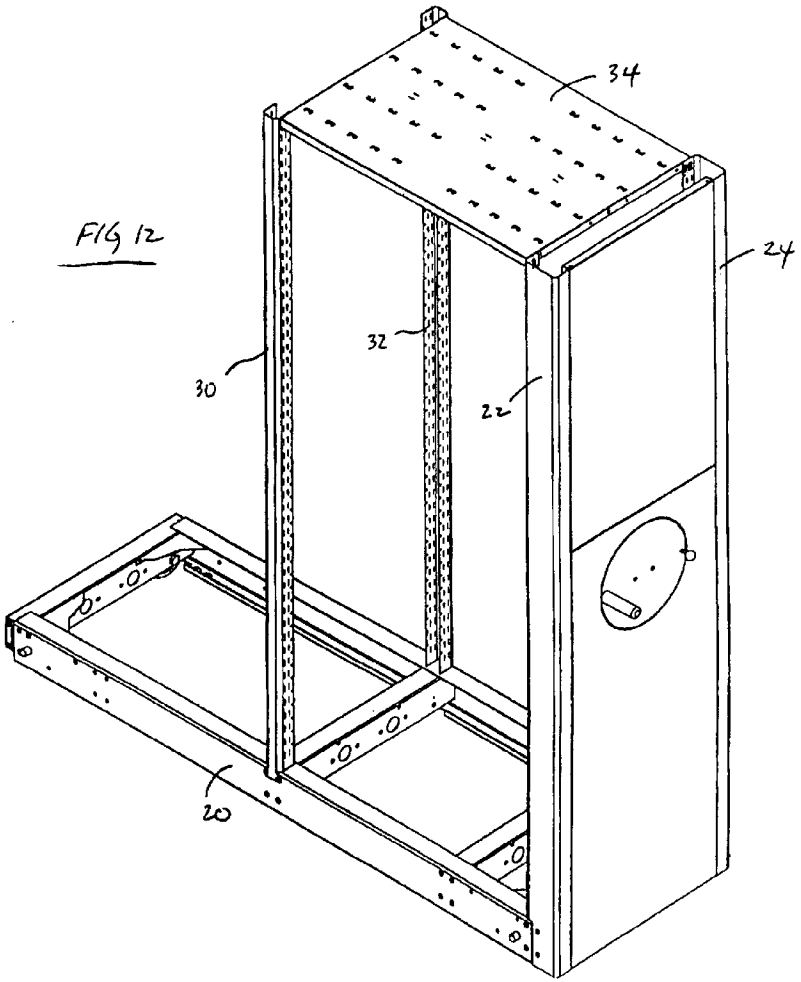
FIG. 12 is an isometric view of the partially assembled shelf unit illustrating the top shelf fully installed.

Referring now to FIG. 10, the shelf 34 is shown in more detail. The shelf includes a generally rectangular panel 190 in which are three pairs of slits 192, 194, 198 centrally located on the panel and four series of cutouts 200, 202, 204, 206, two cutout series to either side of the slits. The shelf also includes four corner portions 210, 212, 214, 216 formed by border flanges, such as a longitudinal flange 220 and a lateral flange 222. The four corner portions are received by four clips as shown in FIGS. 11 and 12. In FIG. 11, the shelf 34 is supported on its right side by two clips 224, 226 attached to the corner posts 22, 24 but not yet by the clips attached to the intermediate posts 30, 32. By tilting the shelf counterclockwise, the shelf also engages the clips, such as the clip 130, attached to the intermediate posts 30, 32. In this fashion all of the shelves shown in FIG. 1 may be quickly and easily connected to the posts. The wide slots 138, 140 of each clip are wide enough to allow connection to the posts and also have room to receive the flanges, such as the flange 222, of the shelves until the flanges engage the bottom edges 151, 152.

Figure 13:
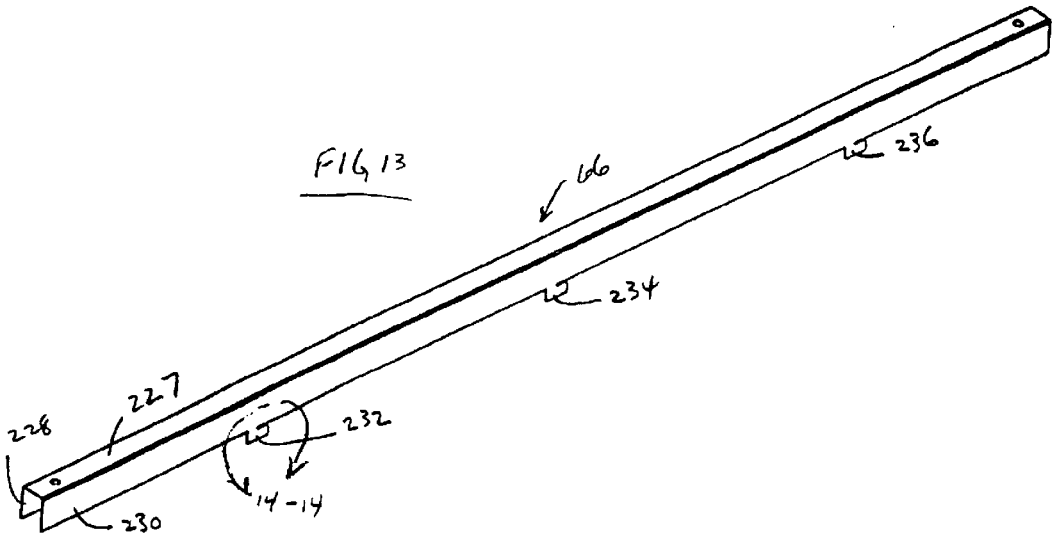
FIG. 13 is an isometric view of a barrier element.
Figure 14:
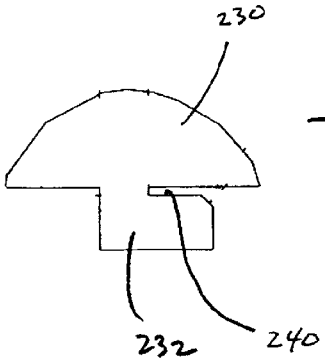
FIG. 14 is an enlarged elevation view of a barrier element tab taken within the circle 14—14 of FIG. 13.
Figure 15:
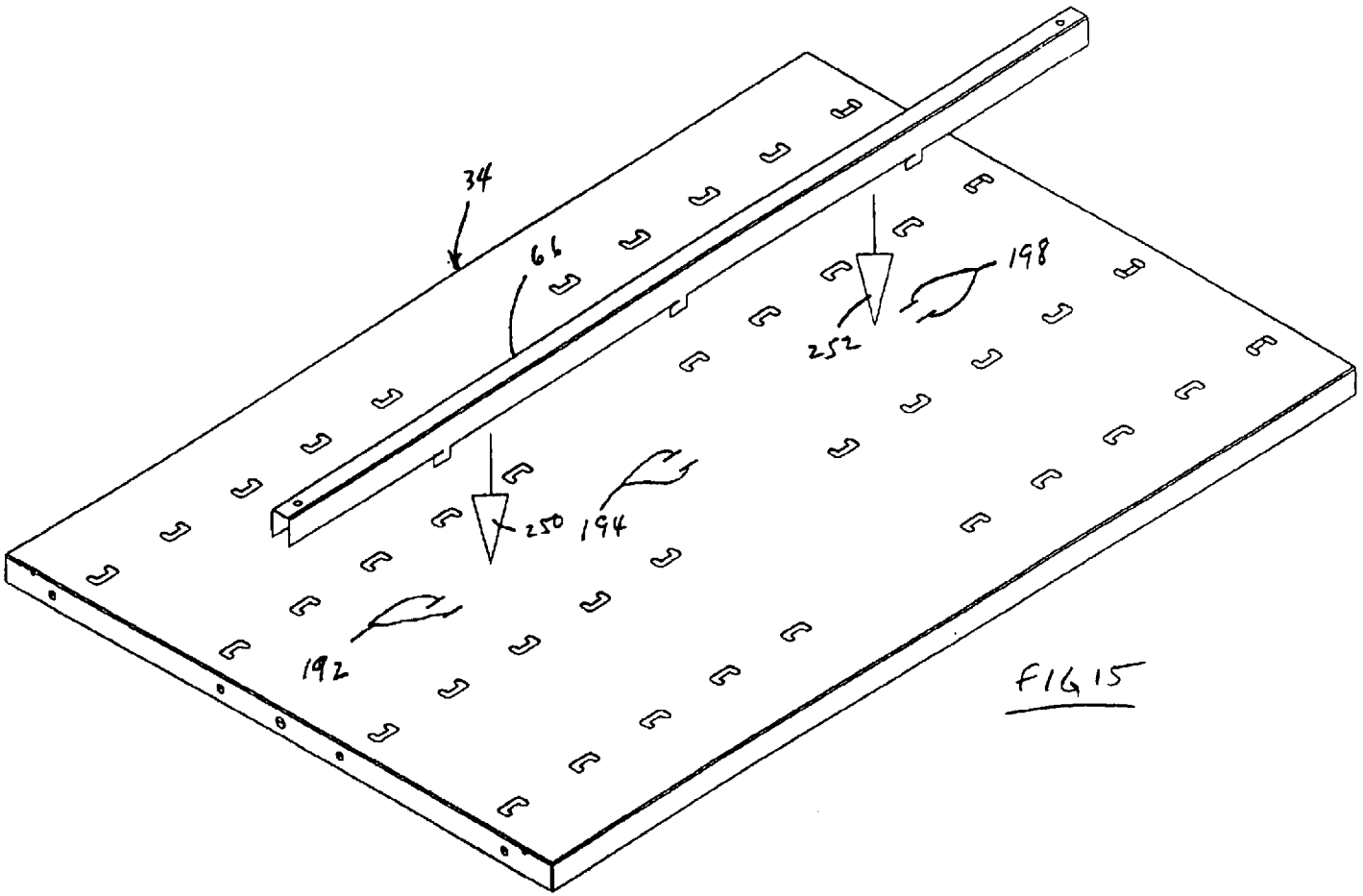
FIG. 15 is an isometric view illustrating a first step in the assembly of a barrier element and the shelf.
Figure 16:
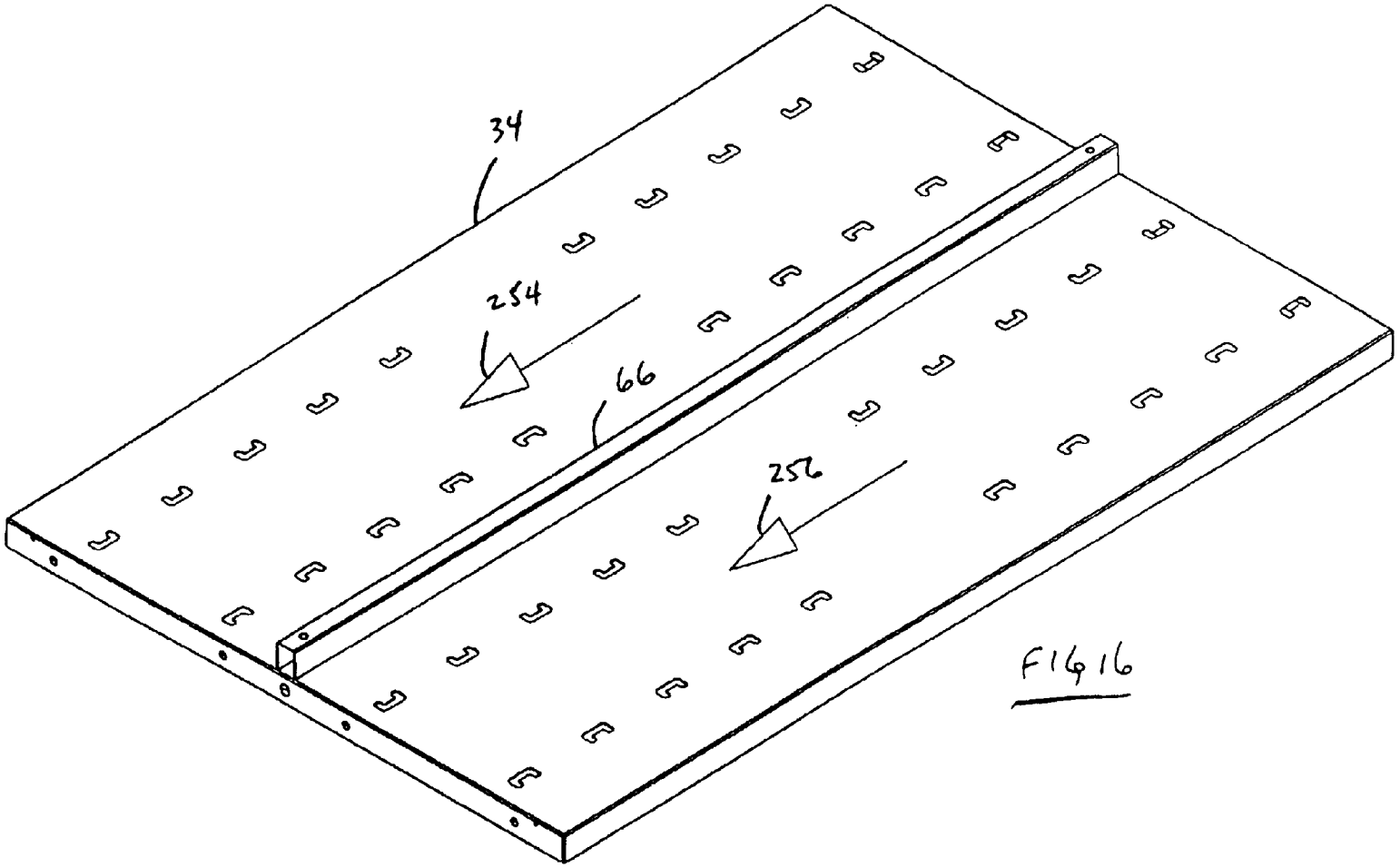
FIG. 16 is an isometric view of the shelf and the barrier element illustrating a second step of assembly.

Referring now to FIGS. 13 and 14, the barrier element 66 is shown in detail. The element is C-shaped with a base portion 227 and two arm portions 228, 230. At the end of each of the arm portions, such as the arm portion 230, are three attachment tabs 232, 234, 236, each having a generally L-shaped configuration such that a slot 240 is formed, for example, between the tab 232 and the arm portion 230 of sufficient depth or width to receive the thickness of the panel portion 190 of the shelf 34. Installation of the barrier element 66 requires that the tabs be aligned with the three pairs of slits 192, 194, 198 in the center of the shelf, FIG. 15, and inserted as directed by the arrows 250, 252. Thereafter, the barrier element 66 is slid to the left as depicted in FIG. 16, by the arrows 254, 256 so as to engage the shelf and the barrier element slot. The barrier elements act to block the insertion of file folders beyond the barrier element thereby providing that the file folders are all in alignment and providing an aesthetically pleasing appearance. Also, file folders from one side of a shelf unit will not interfere with the insertion of file folders from the opposite side of the shelf unit.

Assembly of the shelf unit may be done quite easily and quickly using relatively few and inexpensive parts. In the usual fashion the carriage parts are provided and the four corner frame members are erected by being fastened to the carriage using the same screw fasteners intended for assembly of the carriage alone. The same screw fasteners used between the carriage longitudinal members and selected lateral members also attach the intermediate frame posts to the carriage. Cross braces 260, 262, FIG. 2, may be installed and the barrier elements may be engaged with most of the shelves. Then, a plurality of clips are attached to the corner and the intermediate posts in a predetermined fashion to support the shelves. The shelves may be easily and quickly installed so as to be supported by the clips and in turn by the posts.

It is understood that should banker boxes be stored rather than individual file folders, the shelves may not need barrier elements nor have any of the slits or cutouts illustrated in FIG. 1. It is further understood that while specific examples of posts, clips, shelves, barrier elements and the like are given, each of these items represent all such similar items of a shelf unit.

The above specification describes in detail the preferred embodiment of the present invention. Other examples, embodiments, modifications and variations will, under both the literal claim language and the doctrine of equivalents, come within the scope of the invention defined by the appended claims. For example, the various shapes of the corner posts, the intermediate posts and the shelves may be altered and still be considered to be equivalent structures. As mentioned, the shelves may not have slits or cutouts. Or, the barrier elements may have tabs but no slots, or the barrier elements may not be used. Further, they will all come within the literal language of the claims. Still other alternatives will also be equivalent as will many new technologies. There is no desire or intention here to limit in any way the application of the doctrine of equivalents nor to limit or restrict the scope of the invention.

What is claimed is:

1. A mobile shelf system comprising:

a track;

a carriage adapted to move along said track, said carriage including longitudinal and cross members and fasteners for attaching said longitudinal and cross members of said carriage together;

vertically disposed corner frame members connected to said carriage;

vertically disposed frame posts located intermediate said corner frame members and being connected to said carriage with said fasteners of said carriage;

a plurality of clips connected to said corner frame members and said intermediate frame posts for connecting shelves to said corner frame members and to said intermediate posts;

a plurality of shelves connected to said corner frame members and to said intermediate posts, each shelf being mounted to selected groupings of four clips of said plurality of clips;

a plurality of barrier elements connected to selected shelves of said plurality of shelves for limiting the depth of storage insertion; and wherein each of said frame posts is generally U-shaped with a depending tab, said tab having two laterally spaced fastener openings.

2. The system as claimed in claim 1 wherein:

each of said frame posts is connected to said carriage by passing said carriage fasteners through said laterally spaced fastener openings.

3. The system as claimed in claim 2 wherein:

said tab has a generally up-side-down T-shape, with a head and a body, and said laterally spaced fastener openings being located in said head.

4. The system as claimed in claim 1 wherein:

each of said plurality of barrier elements has a generally C-shape with a base portion and two arm portions and attachment tabs extending from ends of said arm portions.

5. The system as claimed in claim 4 wherein:

each of said attachment tabs has a generally L-shaped configuration and forms, with said connected arm portion, a slot larger than the thickness of a shelf.

6. The system as claimed in claim 5 wherein:

each of said plurality of shelves includes a series of slits for receiving said attachment tabs of a barrier element.

7. The system as claimed in claim 1 wherein:

each of said plurality of clips is generally C-shaped and includes a base portion and two arm portions, each of said arm portions having two vertically disposed slots, an upper slot and a lower slot, said upper slot being wider than said lower slot.

8. The system as claimed in claim 7 wherein:

each of said plurality of barrier elements has a generally C-shape with a base portion and two arm portions and attachment tabs extending from ends of said arm portions.

9. The system as claimed in claim 8 wherein:

each of said plurality of shelves includes a flange which is receivable by said upper slot of a respective clip.

10. The system as claimed in claim 9 wherein:

each of said frame posts is connected to said carriage by passing carriage fasteners through said laterally spaced fastener openings;

said upper slot is about twice as wide as said lower slot; and each of said attachment tabs has a generally L-shaped configuration and forms, with said connected arm portion, a slot larger than the thickness of a shelf.

11. The system as claimed in claim 10 wherein:

each of said arm portions of each clip of said plurality of clips is receivable by a slit in said corner frame members or in said frame posts and each of said arm portions receives a portion of a shelf in said upper slot; and each of said plurality of shelves includes a series of slits for receiving said attachment tabs of a barrier element.

12. The system as claimed in claim 11 wherein:

said upper and said lower slots each includes an inner edge, the inner edges being aligned with one another; and said lower slot includes an outer edge which is longer than the inner edge of said lower slot.

13. The system as claimed in claim 12 wherein:

said upper slot includes an outer edge which is at a higher elevation than said inner edge of said upper.

14. A mobile shelf system comprising:

a track;

a carriage adapted to move along said track, said carriage including longitudinal and cross members and fasteners for attaching said longitudinal and cross members of said carriage together;

vertically disposed corner frame members connected to said carriage;

vertically disposed frame posts located intermediate said corner frame members and being connected to said carriage with said fasteners of said carriage;

a plurality of clips connected to said corner frame members and said intermediate frame posts for connecting shelves to said corner frame members and to said intermediate posts;

a plurality of shelves connected to said corner frame members and to said intermediate posts, each shelf being mounted to selected groupings of four clips of said plurality of clips; and wherein each of said plurality of clips is generally C-shaped and includes a base portion and two arm portions, each of said arm portions having two vertically disposed slots, an upper slot and a lower slot, said upper slot being wider than said lower slot.

15. The system as claimed in claim 14 wherein:

said upper slot is about twice as wide as said lower slot.

16. The system as claimed in claim 14 wherein:

each of said arm portions of each clip of said plurality of clips is receivable by a slit in said corner frame member or in said frame post; and each of said arm portions of each clip receives a portion of a shelf in said upper slot.

17. The system as claimed in claim 16 wherein:

said upper and said lower slots each includes an inner edge, the inner edges of said slots being aligned with one another; and said lower slot includes an outer edge which is longer than the inner edge of said lower slot.

18. The system as claimed in claim 17 wherein:

said upper slot includes an outer edge which is at a higher elevation than said inner edge of said upper slot.

19. The system as claimed in claim 14 wherein:

each of said plurality of shelves includes a flange which is receivable by said upper slot of a respective clip.

20. A method for assembling a mobile shelving system comprising the steps of:

providing tracks;

forming a carriage to move along said tracks, said carriage including longitudinal and cross members and fasteners;

providing vertically disposed corner and intermediate posts, each of said intermediate posts having a generally U-shape and including a depending tab, said tab having two laterally spaced fastener openings;

connecting said corner and intermediate posts to said carriage using fasteners from said carriage;

providing a plurality of clips, each of said clips having a generally C-shape including a base portion and two arm portions, each of said arm portions having two vertically disposed slots, an upper slot and a lower slot wherein said upper slot is wider than said lower slot;

installing said clips on said posts in a predetermined manner;

mounting a shelf in upper slots of four clips in a predetermined manner;

providing barrier elements; and mounting said barrier elements to selective shelves.

* * * * *